US007152256B1

(12) United States Patent
Roberts

(10) Patent No.: US 7,152,256 B1
(45) Date of Patent: Dec. 26, 2006

(54) PADDED TUB LINER

(76) Inventor: Holly Roberts, 932 Grove Ave., Baltimore, MD (US) 21222

( * ) Notice: Subject to any disclaimer, the term of this patent is extended or adjusted under 35 U.S.C. 154(b) by 178 days.

(21) Appl. No.: 10/764,357

(22) Filed: Jan. 23, 2004

(51) Int. Cl.
*A47K 3/02* (2006.01)

(52) U.S. Cl. ..... 4/583; 4/580; 4/581; 4/582

(58) Field of Classification Search ..... 4/580–583
See application file for complete search history.

(56) References Cited

U.S. PATENT DOCUMENTS 4,051,563 A 10/1977 Clarke, Jr.
4,630,323 A * 12/1986 Sage et al. ..... 4/580
4,956,882 A 9/1990 Cohn
5,040,252 A * 8/1991 Taggart ..... 4/580
5,715,546 A * 2/1998 Kvalvik ..... 4/580
5,839,132 A 11/1998 Rooney
6,085,367 A * 7/2000 Guiste ..... 4/580
6,357,061 B1 * 3/2002 Gonzalez ..... 4/580
6,681,416 B1 * 1/2004 Yang ..... 4/583

* cited by examiner

*Primary Examiner*—Tuan Nguyen

(57) ABSTRACT

A padded tub liner for protecting a user from an impact caused by slipping in a bathtub. The padded tub liner includes a bottom portion designed for resting upon a bottom surface of the bathtub; a first side portion operationally coupled to the bottom portion, and designed for abutting a side surface of the bathtub; and a second side portion operationally coupled to the bottom portion opposite the first side portion, and designed for abutting a second side surface of the bathtub.

1 Claim, 4 Drawing Sheets

PADDED TUB LINER

BACKGROUND OF THE INVENTION

1. Field of the Invention

The present invention relates to tub liners and more particularly pertains to a new padded tub liner for protecting a user from an impact caused by slipping in a bathtub.

2. Description of the Prior Art

The use of tub liners is known in the prior art. Illustrative examples include: U.S. Pat. No. 4,051,563; U.S. Pat. No. 4,956,882; and U.S. Pat. No. 5,839,132.

While these devices fulfill their respective, particular objectives and requirements, the need remains for a device that includes a non-slip layer abutting the surface of the bath tub, a impact absorbing middle layer, and a cloth covering for abutting the skin of a user.

SUMMARY OF THE INVENTION

Everyone should have a healthy respect for the bathtub, a respect bordering on fear. That's because the bathtub is not simply a place to wash the body clean from a day's labor. The bathtub is a dangerous place, an accident waiting to happen. Bathtub falls are particularly common with elderly consumers, as limited mobility brought on by such conditions as arthritis or stroke can make the simple act of climbing in and out of the tub extremely difficult. According to the National Safety Council, slips and falls are the leading cause of accidental deaths among people over the age of 75 and the second leading cause for those aged 45 to 75. Accounting for many of these falls; the bathtub. For prudent individuals the fear of slipping and falling while bathing must be paramount in their minds. Over the years many attempts have been made to make the bathtub a safer environment. The CDC recommends the use of rubber tub mats as a first step in preventing bathtub falls, along with having safety handrails and grab bars installed.

Although these efforts to improve bathtub safety has proven successful on some levels, there are a number of drawbacks associated with their use. Specifically, many consumers find that items such as nonskid decals and rubber bathmats, are often ineffective in preventing falls. Over time and use, decals can become frayed and useless, while rubber bathmats can easily slip and move if water or soap should get underneath the mat. Even tubs that come with a factory "nonskid" feature quickly lose their so called "nonskid" surface. In some cases, this factory non skid surface actually damages the tub itself over time. As for safety handrails and grab bars all around them; although shower chairs, grab rails, rubber mats, etc., are effective to some degree, the fact remains that the bottom of the bathtub is still a dangerous area. When you add soap, water, oil and other liquids commonly applied in the bathtub, the danger only increases.

The present invention is a sponge-padded rubber liner specially designed to encompasses the bottom and both sides of a bathtub. Manufactured from pliable rubber, the invention would be produced in a variety of shapes and sizes for use with the various makes and models bathtubs available on the market, with a standard fifty-four by forty-eight inch (54'×48') liner presented here for review. Rectangular in shape, the invention would be designed to encompass the bottom and inner side walls of the bathtub, extending over these walls and resting on the outer edges of the tub. Most notably, the inventions side walls are covered in a cushiony soft sponge padding designed to provide an effective barrier between the hard tub and the bather. For optimal comfort, this padding is further covered in plush terry cloth material. Positioned at the proximal end of each side wall is a series of hook and loop (more commonly referred to as Velcro®) fasteners. These fasteners are designed to be used in conjunction with an optional inflatable pillow sold alongside the unit. Designed to enable the bather to comfortably recline in the tub, this pillow would be covered in the same soft, terry cloth material as the liner, and would be easily secured to the liner's Velcro® fasteners by way of corresponding fasteners located on the back of the pillow. The invention would be held securely in place within the bathtub via a series of durable, circular shaped suction cups which are positioned in rows, encompassing the entire surface area of the underside of the unit.

Use of the invention would be very simple and straightforward. First, consumers would place the invention in the bathtub, centering the device so that both sides reach an equal height along the sides of the tub, and in a position where the Velcro® at the end of each side section almost met at the head of the tub. Next, consumers would apply even, downward pressure with the palms of their hands to the bottom and sides of the liner so the suction cups on the liner bottom would securely adhere to the surface of the tub The pillow portion of the headrest would now be inflated and its Velcro® backing pressed onto the Velcro® surface along the ends (head) of the liner. After securely positioning the unit in place, the user would simply fill their bath with water and if desired, would add salts, oils or bubbles. The user would then simply climb into his or her bathtub, lie back and relax. At the end of the bath, the tub would be drained and the user would simply step out, dry off and go about their day's scheduled activities. The invention could be left in place between uses, or could be removed after use, to be stored in any bathroom closet or drawer, until again needed.

The invention would offer consumers a number of important benefits and advantages. Foremost, the invention would provide consumers a simple and safe means of utilizing a bathtub. Consumers should appreciate that simply by installing this unique safety device within their tub, the extent of injuries received from an accidental bathtub slip and fall could be greatly decreased, if not outright avoided. The rubber surface of the invention would provide a secure foothold to help prevent a fall from ever occurring. In a worst case scenario, the pliable, sponge-padded sides would offer significant protection from the tub's hard surface. In this manner, the invention would be an ideal environment in which to bathe a small child. Caregivers to wiggling, squiggling little babies would breath a little easier at bath time when using the invention. Another practical application would be for older citizens or those with limited mobility. Some elderly and disabled persons are subject to falling over when sitting in a bathtub, and could likewise benefit from the protection this product would provide. Soft and comfortable to use, the invention would not only increase the level of bathing safety, but the level of bathing comfort. Along with the optional headrest, this cleverly designed bath liner could make an ordinary bath seem a mini spa experience.

To this end, the present invention generally comprises a bottom portion designed for resting upon a bottom surface of the bathtub; a first side portion operationally coupled to the bottom portion, and designed for abutting a side surface of the bathtub; and a second side portion operationally coupled to the bottom portion opposite the first side portion, and designed for abutting a second side surface of the bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
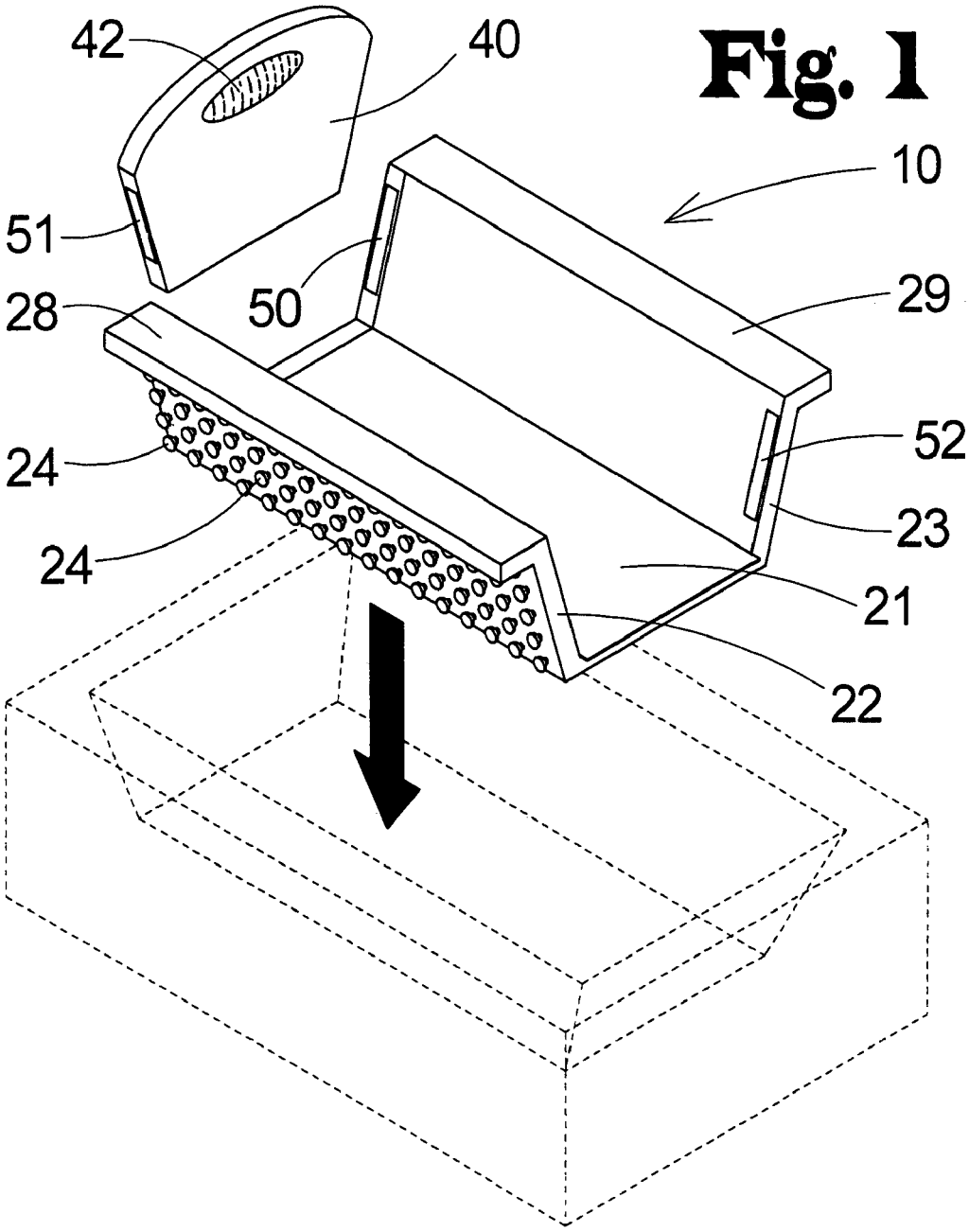
FIG. 1 is a schematic perspective view of a new padded tub liner according to the present invention.
Figure 2:
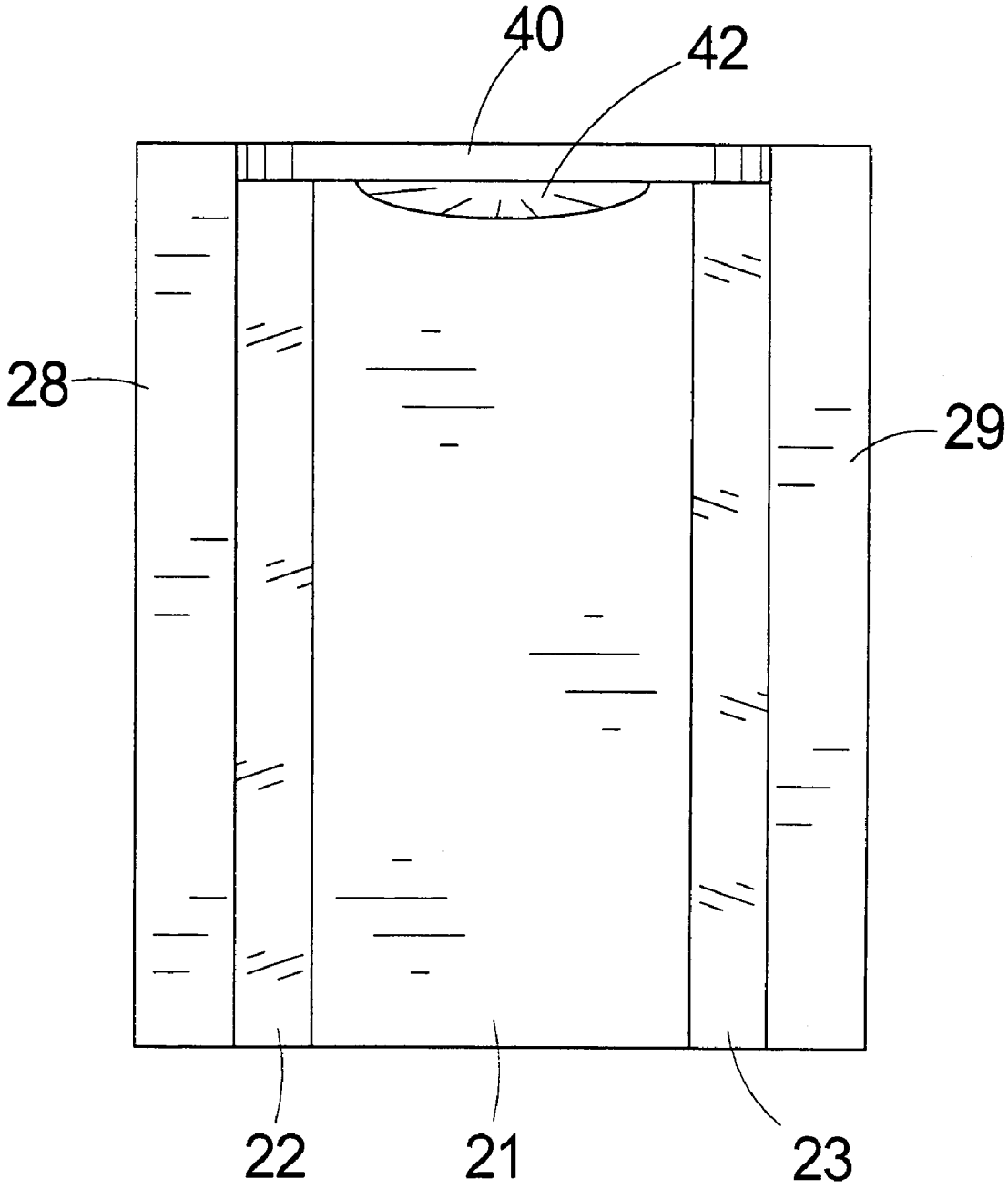
FIG. 2 is a schematic top view of the present invention.
Figure 3:
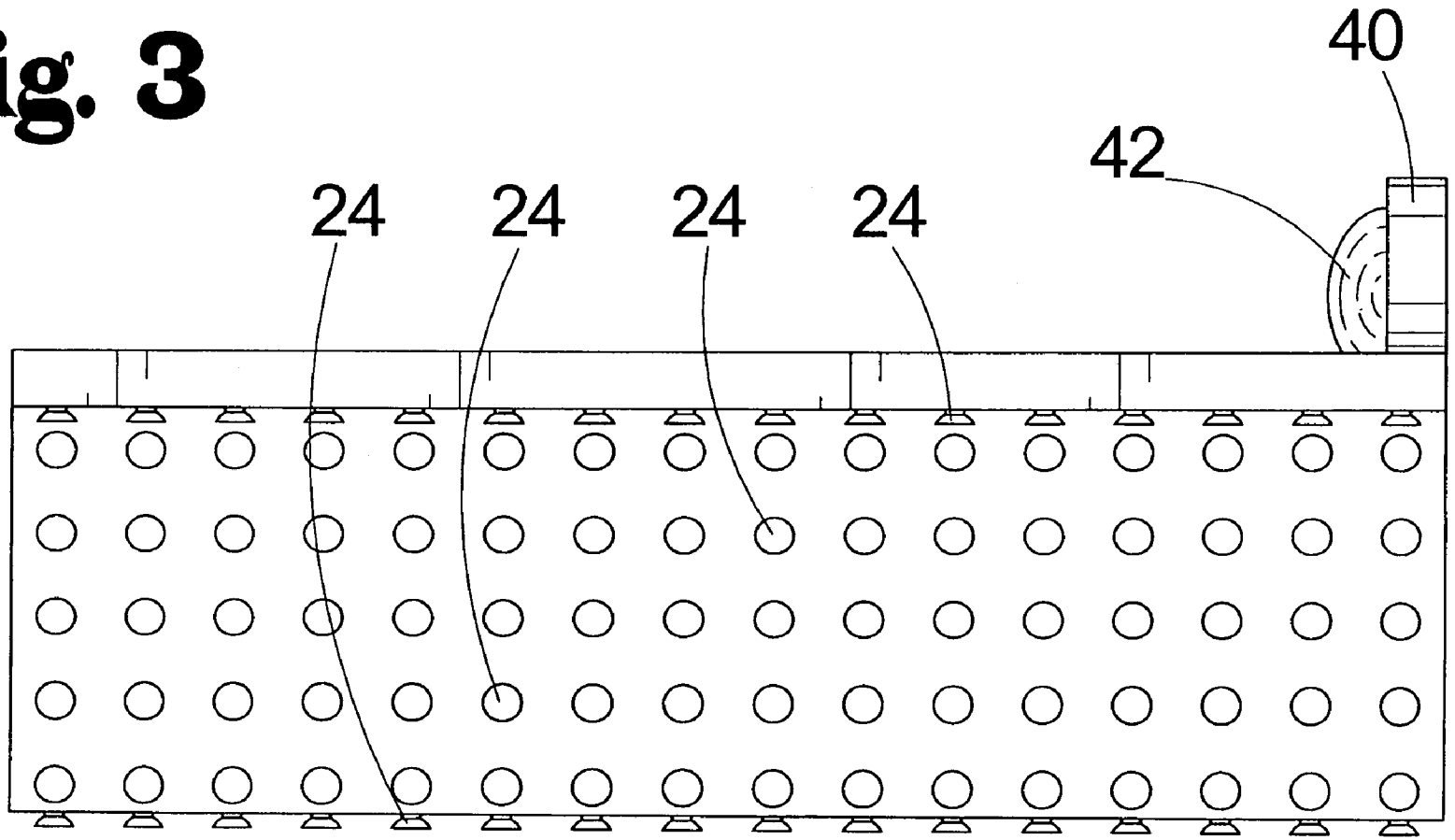
FIG. 3 is a schematic side view of the present invention.
Figure 4:
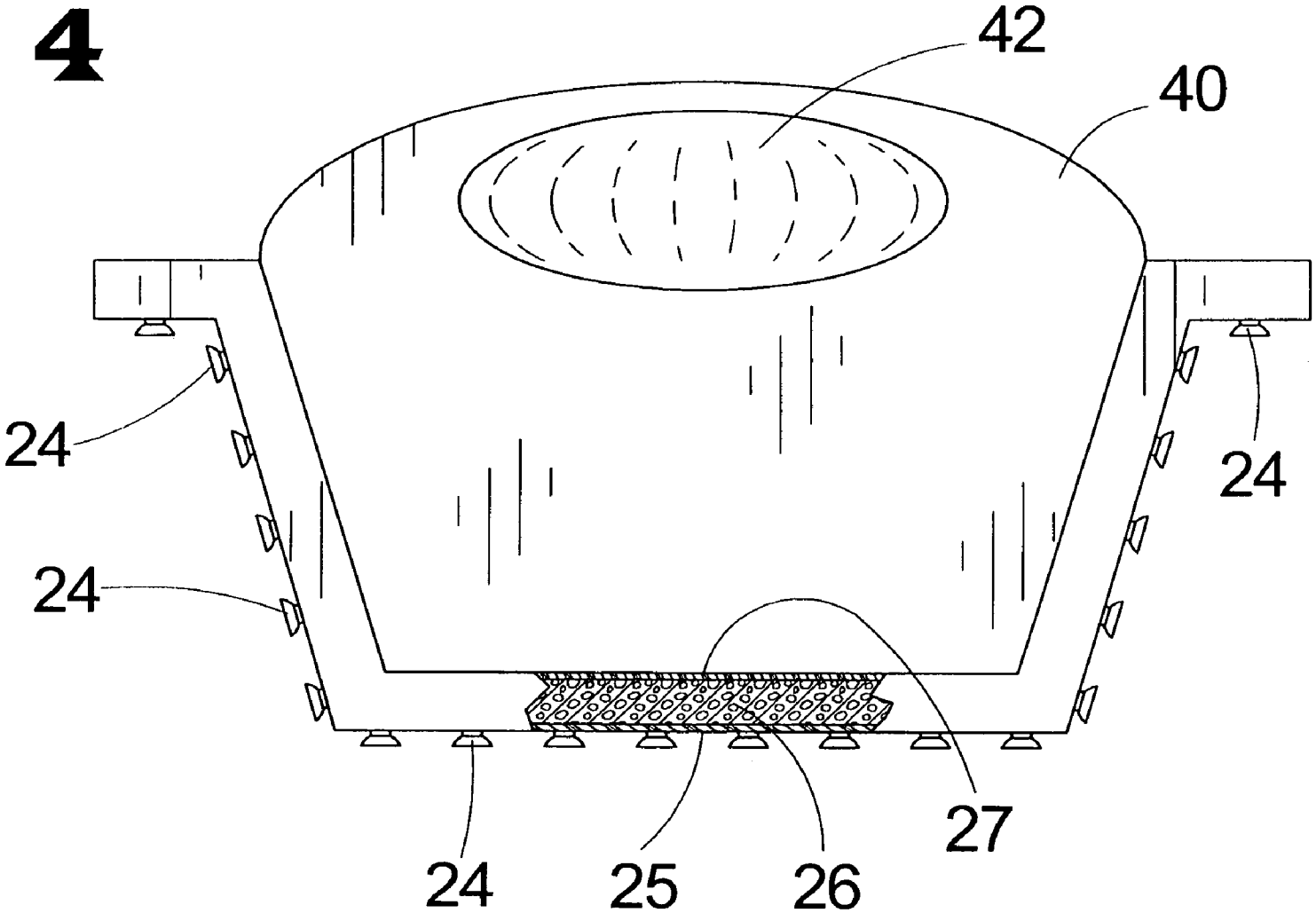
FIG. 4 is a schematic front view of the present invention.

With reference now to the drawings, and in particular to FIGS. 1 through 4 thereof, a new padded tub liner embodying the principles and concepts of the present invention and generally designated by the reference numeral 10 will be described.

As best illustrated in FIGS. 1 through 4, the padded tub liner 10 generally comprises a bottom portion 21, a first side portion 22, and a second side portion 23.

The bottom portion 21 is designed for resting upon a bottom surface of the bathtub. The first side portion 22 is operationally coupled to the bottom portion 21, and is designed for abutting a side surface of the bathtub. Similarly, the second side portion 23 is also operationally coupled to the bottom portion 21 opposite the first side portion 22, and is designed for abutting a second side surface of the bathtub.

In a preferred embodiment, the first side portion 22 is integrally coupled to the bottom portion 21 and the second side portion 23 is also integrally coupled to the bottom portion 21. The bottom portion 21, first side portion 22, and second side portion 23 form a main liner member 20.

In a further embodiment, the main liner member 20 further comprises an external layer 25, a plurality of suction cups 24, an interior layer 26, and an outer cloth covering 27. The external layer 25 abuts a surface of the bathtub and preferably comprises a polymeric material for inhibiting the main liner member 20 from sliding along the surface of the bathtub. Each one of the plurality of suction cups 24 is operationally coupled to an external surface of the main liner member 20. Each one of the plurality of suction cups 24 is for selectively securing the main liner member 20 to a surface of the bathtub. The interior layer 26 provides padding for minimizing an impact against the main liner member 20. Thus, a user is at least partially protected from an impact due to slipping or falling in the bathtub. The outer cloth covering 27 is designed for abutting skin of a user when the main liner member 20 is positioned in the bathtub.

In still a further embodiment, the interior layer 26 comprises a sponge.

In yet a further embodiment, the outer cloth covering 27 comprises terry cloth.

In even still a further embodiment, a first top portion 28 is integrally coupled to the first side portion 22 for abutting a top surface of the first side of the bathtub, and a second top portion 29 is integrally coupled to the second side portion 23 for abutting a top surface of the second side of the bathtub.

In an embodiment the first top portion 28 and the second top portion 29 further comprise a plurality of suction cups 24 positioned on a bottom surface of the top portion 28,29 for selectively securing the top portion 28,29 to the top surface of the side of the bathtub.

In even still a further embodiment, a headrest portion 40 is operationally couplable to the main liner member 20. The headrest portion 40 is for supporting a head or back of the user.

In an embodiment the headrest portion 40 further comprises a plurality of suction cups 24 coupled to a rear surface of the headrest portion 40 for selectively securing the headrest portion 40 to an end of the bathtub.

In a further embodiment, a plurality of fastening means 50 are used to selectively secure the headrest portion 40 to the main liner member 20. Preferably, the plurality of fastening means 50 comprises a quartet of first portions of hook and loop fastener 51, and a pair of second portions of hook and loop fastener 52. The second portions 52 are complementary to the first portions 51. Each one of the quartet of hook and loop fastener 51 is coupled to a medial portion of an associated end of an associated one of the first side portion 22 and the second side portion 23. Each one of the pair of second portions of hook and loop fastener 52 is coupled to a medial portion of an associated side of the headrest portion 40. Thus, the headrest portion 40 is selectively couplable to the first 22 and second side portion 23 of the main liner member 20 at either end of the main liner member 20.

In yet a further embodiment, the headrest portion 40 further comprises an inflatable pillow section 42 positioned adjacent a top edge of the headrest portion 40. The inflatable pillow portion 42 provides additional support for a user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathtub mat assembly for selectively lining a conventional bathtub comprising:

a bottom portion adapted for resting upon a bottom surface of the bathtub;

a first side portion operationally coupled to said bottom portion, said first side portion being adapted for abutting a side surface of the bathtub;

a second side portion operationally coupled to said bottom portion opposite said first side portion, said second side portion being adapted for abutting a second side surface of the bathtub;

wherein said first side portion being integrally coupled to said bottom portion and said second side portion being integrally coupled to said bottom portion, said bottom portion, first side portion, and second side portion forming a main liner member, said main liner member being elongate with opposite ends, said main liner member defining substantially U-shaped openings at said opposite ends being bounded by said bottom portion and said side portions and forming a channel;

wherein said main liner member further comprises:

an external layer comprising a polymeric material, said external layer being for abutting a surface of the bathtub, said polymeric material being for inhibiting said main liner motion from sliding along the surface of the bathtub;

a plurality of suction cups operationally coupled to an external surface of said main liner member, each one of said plurality of suction cups being for selectively securing said main liner member to a surface of the bathtub;

a interior layer providing padding for minimizing an impact against said main liner member whereby a user is at least partially protected from an impact due to slipping or falling in the bathtub, wherein said interior layer comprises a sponge;

an outer cloth covering adapted for abutting skin of a user when said main liner member is positioned in the bathtub, wherein said outer cloth covering comprises terry cloth;

a first top portion integrally coupled to said first side portion, said first top portion being for abutting a top surface of the first side of the bathtub;

a second top portion integrally coupled to said second side portion, said second top portion being for abutting a top surface of the second side of the bathtub;

wherein said first top portion and said second top portion further comprise a plurality of suction cups positioned on a bottom surface of said top portion for selectively securing said top portion to the top surface of the side of the bathtub;

a headrest portion for supporting a head or back of the user, said headrest portion being positionable in one of said openings and being removably mounted on said main liner member in said opening;

wherein said headrest portion further comprises a plurality of suction cups coupled to a rear surface of said headrest portion for selectively securing said headrest portion to an end of the bathtub;

a plurality of fastening means for selectively securing said headrest portion to said main liner member.

* * * * *